US005362251A

United States Patent [19]

Bielak

[11] Patent Number: 5,362,251

[45] Date of Patent: Nov. 8, 1994

[54] SOLDERLESS COAXIAL CONNECTOR PLUG

[75] Inventor: Kenneth J. Bielak, Chicago, Ill.

[73] Assignee: Switchcraft Inc., Chicago, Ill.

[21] Appl. No.: 158,085

[22] Filed: Nov. 24, 1993

Related U.S. Application Data

[63] Continuation of Ser. No. 15,113, Feb. 9, 1993, abandoned.

[51] Int. Cl.[5] ..... H01R 4/24

[52] U.S. Cl. ..... 439/394; 439/584

[58] Field of Search ..... 439/578–585, 439/417–419, 392–394, 426, 425, 675

[56] References Cited

U.S. PATENT DOCUMENTS

| | | | |
|---|---|---|---|
| 3,683,320 | 8/1972 | Woods et al. | 439/394 |
| 3,744,007 | 7/1973 | Horak | 439/394 |
| 3,977,752 | 8/1976 | Freitag | 439/394 |
| 4,739,126 | 4/1988 | Gutter et al. | 439/394 |
| 5,066,248 | 11/1981 | Gaver, Jr. et al. | 439/394 |

*Primary Examiner*—David L. Pirlot
*Attorney, Agent, or Firm*—William R. Clark

[57] ABSTRACT

A solderless audio connector plug including a handle, a plug body, and a conductive sheath having fingers flared outwardly with the free ends pointing inwardly. In assembly, the end of a coaxial cable is inserted through a bore in the handle, and then inserted into the sheath. The plug body is then screwed to the handle, and, as the two are drawn together, the sheath is forced into the bore of the handle. The bore tapers downwardly pushing the fingers inwardly to pierce the outer insulation layer of the coaxial cable. Further, a pointed end of a tip rod is aligned within the plug body to make contact with the center conductor of the coaxial cable. In such manner, electrical continuity is established between the outer conductor and the plug body, and also between the center conductor and the tip rod.

18 Claims, 2 Drawing Sheets

SOLDERLESS COAXIAL CONNECTOR PLUG

This application is a continuation of application Ser. No. 015,113 filed Feb. 9, 1992, now abandoned.

BACKGROUND OF THE INVENTION

This invention generally relates to audio connector plugs for coaxial cable, and more particularly relates to method and apparatus for connecting such plugs to coaxial cable without the use of solder.

As is well known, two conductor coaxial cable with so called ¼" phone plugs is commonly used to interconnect audio equipment such as amplifiers, microphones, and electrified instruments such as guitars and keyboards. Generally, such plugs have a cylindrical body that inserts in a mating jack of the audio equipment, and the cylindrical body surrounds a tip rod that projects beyond the body. The tip rod is electrically insulated from the cylinder body, and is connected to the center conductor of the coaxial cable. The cylinder body is typically connected to a rear housing that is electrically connected to the outer conductor of the coaxial cable. It has been common practice to use solder connections to connect the respective coaxial conductors to such audio plugs.

As is also well known, audio connector plugs have also been attached to coaxial cable using solderless connections. Such assembly or fabrication has the general advantage of requiring less labor, and therefore is more cost effective. Also, it may be desirable to fabricate or repair coaxial cables in the field, and tools such as soldering irons may be unavailable or inconvenient to use. In one prior art solderless audio connector plug, the tip rod has a rear termination that is centrally disposed in a cylinder and aligned to make electrical contact with the center conductor of the coaxial cable that is inserted into the cylinder. The cylinder has a tapped radial hole, and a screw is driven inwardly to pierce the outer insulation of the coaxial cable and make electrical contact with the outer conductor. The screw also functions to provide strain relief, or hold the coaxial cable in place. Such assembly has the disadvantage of requiring a tool such as a screw driver on allen wrench to drive the screw through the outer insulation. Also, such assembly deforms the coaxial by applying force from one side, and care must be used to insure the screw makes proper contact without penetrating the outer conductor.

In another prior art audio connector plug assembly method, the outer insulation is stripped away, and the outer conductor is folded back. The center conductor is aligned to make contact with a tip rod in the manner described above, and the housing of the plug contacts the folded back outer conductor. Some tool is then typically used to actuate a strain relief mechanism to secure the coaxial cable. Such assembly has the disadvantage of requiring a tool to prepare the cable, and also labor time is increased.

SUMMARY OF THE INVENTION

It is an object of the invention to provide an improved audio connector plug and method of attaching such plug to a coaxial cable.

It is also an object to provide apparatus and method for connecting an audio connector plug to a coaxial cable without the use of solder.

It is a further object to provide an audio connector plug that can be connected to a coaxial cable with a minimum of labor, and without the use of tools.

It is also an object to provide an audio connector plug that is highly reliable and provides good strain relief for the coaxial cable.

These and other objects and advantages are provided by a method of attaching a connector plug to an end of a coaxial cable having an outer insulation layer surrounding an outer conductor insulated from an inner conductor comprising the following steps. The first steps are inserting the end of the coaxial cable through a central bore of a conductive handle, and then inserting the coaxial cable into a conductive sheath having at least one flexible finger flared outwardly and pointing in the direction of the end of the cable wherein the finger has a free end directed inwardly towards the cable. Another step is forcing the conductive sheath into the bore of the handle to cause a surface portion of the bore to force the finger inwardly wherein the free end pierces the outer insulation layer of the cable and provides electrical continuity between the outer conductor and the handle. The method also includes the step of connecting a conductive plug body insulatingly encasing a tip rod to the handle wherein the tip rod has a tip end and a point end and the point end is aligned to electrically contact the center conductor of the coaxial cable to provide electrical continuity between the center conductor and the tip end of the tip rod. It may be preferable that the forcing step be effected by the connecting step. That is, is may be preferable to connect the body to the handle by screwing the two together, and that a surface be provided to push or urge the conductive sheath into in handle in response thereto.

It may also be preferable that a plurality of the fingers be used, and the fingers be circumferentially spaced around the sheath. Also, the sheath may be cylindrical and have a plurality of windows each aligned to receive or pass a respective one of the free ends of the fingers as the fingers are forced inwardly. In a preferred embodiment, the bore of the handle has an entrance portion having a first diameter, an internal portion having a second diameter less than the first diameter, and a ramp portion of tapered diameter between the entrance portion and the internal portion. Preferably, by sliding engagement during the forcing of the sheath into the bore of the handle, the ramp portion forces the fingers inwardly to pierce the outer insulation. Preferably, the sheath also comprises means responsive to engagement with wall portions of the bore for crimping the sheath to the coaxial cable. Such crimping means may comprise collets that are compressed by the wall portions of the bore. The fingers may comprise a sharp edged fork aligned to straddle the outer conductor.

The invention may also be practiced to advantage with a connector plug adapted for solderless connection to an end of a coaxial cable having an outer insulation layer surrounding an outer conductor insulated from an inner conductor wherein the plug comprises a conductive handle having a central bore adapted for passage of the end of the coaxial cable, and threads at one end thereof. The plug further includes a conductive sheath adapted for insertion of the end of the cable wherein the sheath has at least one and preferably a plurality of flexible fingers flared outwardly and pointing in the direction of the cable end. A conductive body has threads mateable with the threads of the conductive handle to draw the handle and body together to form the connector plug. The body comprises means such as a radial wall for pushing the sheath into the bore in response to the body and handle being drawn together. The bore comprises means for forcing the finger or fingers inwardly to pierce the outer insulation layer and provide electrical continuity between the outer conductor and the handle and plug body. For example, the finger forcing means may comprise a ramp portion of downwardly tapered diameter which compresses the fingers inwardly as the sheath is pushed into the bore. The plug body insulatingly surrounds a tip rod having a tip end and a point end wherein the point end is centrally aligned within the plug body to electrically contact the center conductor of the coaxial cable to provide electrical continuity between the center conductor and the tip end.

With such arrangement, the plug connector can readily and easily be attached to a coaxial connector without solder or tools. Therefore, the labor cost for assembly is minimal, and assembly can be performed in the field where tools may not be readily accessible or convenient to use. Also, no cable preparation such as stripping the outer insulation is required, so the associated assembly time and risk of faulty workmanship is avoided. All that is necessary is that the cable end be inserted through the handle into the sheath, and that the plug body be screwed to the handle. The connections between both conductors and the respective parts of the connector plug are automatically effected or actuated, and high reliability electrical continuity is provided. Further, strain relief is automatically provided by screwing the plug body to the handle to crimp the sheath onto the cable.

BRIEF DESCRIPTION OF THE DRAWINGS

The foregoing objects and advantages will be more fully understood by reading the following description of the preferred embodiment with reference to the drawings wherein.

DESCRIPTION OF THE PREFERRED EMBODIMENT

Figure 1:
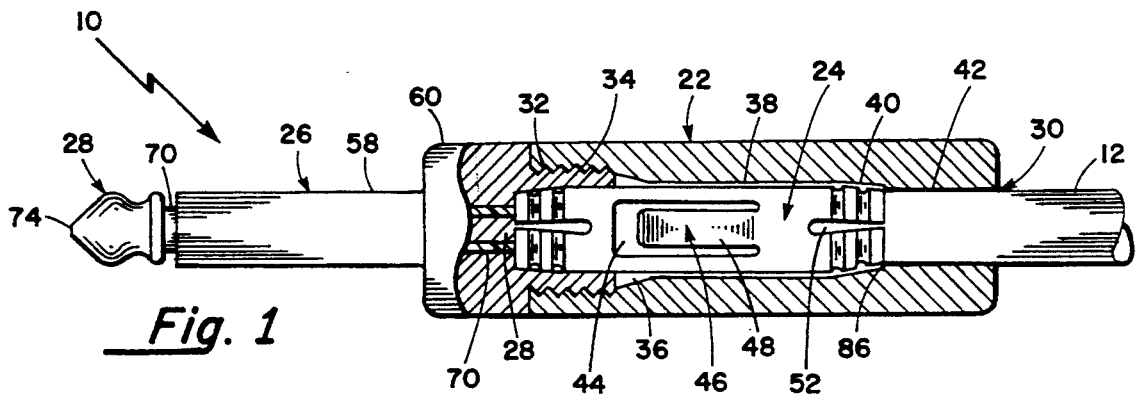
FIG. 1 is a partially sectioned view of a solderless audio connector plug in accordance with the invention.
Figure 3:
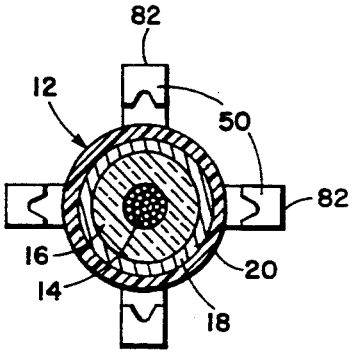
FIG. 3 is a sectioned view of a coaxial cable within the sheath before insertion into the handle.

Referring to FIG. 1, a partially sectioned side view shows audio connector plug 10 attached to an end of coaxial cable 12. Although the invention can be practiced to advantage with other types of coaxial cable plugs, plug 10 is here shown of the type that is commonly referred to as a ¼" phone plug. Typically, such a plug 10 and cable 12 are used to interconnect audio equipment such as amplifiers, microphones and electrified instruments such as electric guitars and keyboards. For example, the plug 10 on one end of the cable 12 is inserted into a suitable mating jack on an electric guitar, and the plug 10 on the opposite end of the cable 12 is inserted into a suitable mating jack on the amplifier. As shown best in FIG. 3, cable 12 is a conventional two conductor coaxial cable having a center conductor 14 which here shown as stranded, but may also be solid. Center conductor insulation 16 surrounds center conductor 14 and electrically insulates it from outer conductor 18 which is here shown as metal and may preferably be braided, spiral, molded, etc. Outer conductor 18 is covered by an outer insulation layer 20 or outer jacket. As is well known, the input signal is coupled to the center conductor 14, and shielding is provided by the outer conductor 18 which is grounded.

Figure 4:
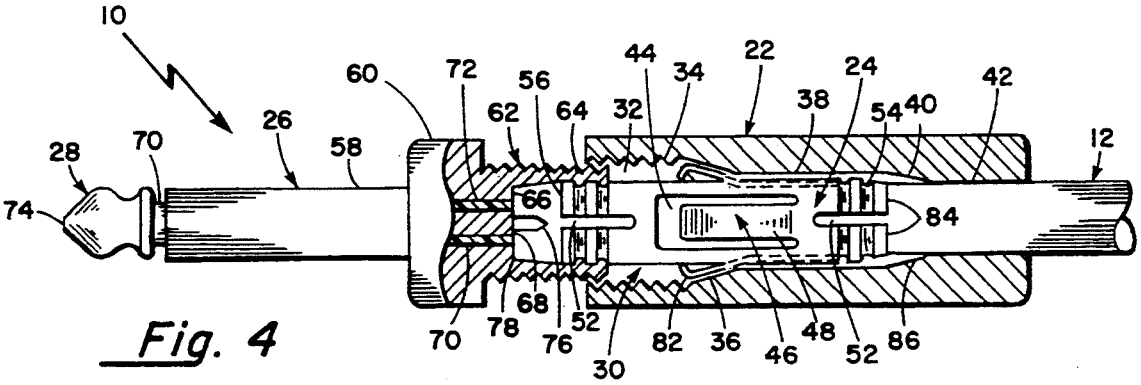
FIG. 4 is a partially sectioned view of the solderless audio connector plug before the handle and plug body are screwed together.

Still referring to FIG. 1 and also to FIG. 4, connector plug 10 includes a conductive handle 22, a conductive sheath 24, and a plug body 26 that surrounds or encases tip rod 28. In particular, handle 22 is a metal cylinder having a longitudinal bore 30 which has an entrance portion 32 of predetermined diameter D1. As shown, entrance portion 32 has screw threads 34. Entrance portion 32 leads to ramp portion 36 whose diameter tapers downwardly to internal portion 38 that has a diameter D2 that is less than D1. Toward the rear or distal end of handle 22, internal portion 38 of bore 30 tapers down further through a crimping portion 40 to an exit portion 42 through which coaxial cable 12 exits connector plug 10.

Figure 2:
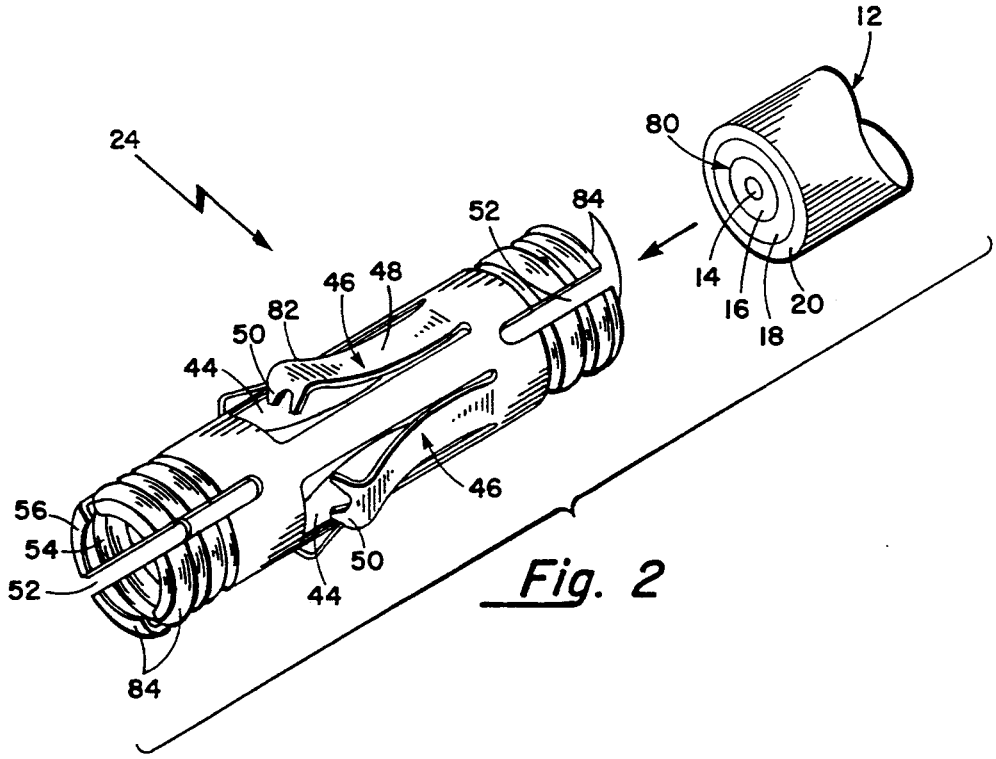
FIG. 2 is a perspective view of the sheath of FIG. 1.

Referring also to FIG. 2, sheath 24 or casing is generally cylindrical metal, and has four windows 44 cut therein. Each window 44 has a flexible metal finger 46 extending from one side thereof, and each finger 46 has an inward bow 48 and then is flared outwardly away from the cylindrical form of sheath 24. Fingers 46 point in the direction of the cable end after assembly. The free end of each of the fingers 46 terminates in an inwardly directed portion having a sharp edge fork 50.

Still referring to FIG. 2, sheath 24 has axial slits 52 at both ends, and a plurality of internal circumferential ribs 54. Further, one end has an inwardly directed lip 56. Sheath 24 may typically made from thin gauge metal that is stamped and formed around into the generally cylindrical form. As will be described, the diameter of sheath 24 is selected to receive coaxial cable 12. Further, an envelope defined by flared fingers 46 is such that it will pass into entrance portion 32 of bore 30, but is compressed by passing into ramp portion 36.

Referring to FIGS. 1 and 4, conductive plug body 26 includes an elongated cylinder 58 having a head member 60 and a rearwardly extending cylinder 62 with external threads 64 that mate with internal threads 34 of bore 30. A wall member 66 with a central aperture 68 is radially disposed within head 60. A conductive tip rod 28 is disposed in an insulator tube 70, and the two together are press fit into a bore 72 passing through head 60 and cylinder 58. Tip rod 28 has a tip end 74 extending beyond the front of cylinder 58 and is there also electrically insulated from conductive cylinder 58 by a portion of insulator tube 70. Tip rod 28 extends back cylinder 58 and protrudes through central aperture 68 where it terminates in a point end 76 which is a nail like structure centrally aligned within the recess of rearwardly extending cylinder 62. Cylinder 62 has an inward wall portion 78 that tapers down to a diameter less than the normal diameter of sheath 24.

In accordance with the invention, the fabrication or assembly of audio connector plug 10 will now be described. Without any preparation of cable 12 other than end 80 being clean cut, end 80 is inserted through bore 30 of conductive handle 22. In particular, cable 12 is inserted in through exit portion 42 of bore 30 and out entrance portion 32. Next, end 80 is inserted into sheath 24. The diameter of sheath 24 is only slightly larger than coaxial cable 12, so as end 80 contacts and passes longitudinally past inward bows 48, outward flaring of fingers 46 is established in a positive manner. That is, the passing of cable 12 against inward bows 48 ensures that fingers 46 are flared outwardly so the forks 50 on the free ends of fingers 46 are out of the way of the advancing cable 12 as it moves during insertion into sheath 24 longitudinally towards lip 56. If a fork 50 is initially protruding through its respective window such that the advancing cable would catch on it, the passing of cable against bow 48 of that finger 46 pushes it out of the way. Eventually, cable end 80 arrives at lip 56 which has an inside diameter less than cable 12, and cable end 80 is stopped there. Thus, conductive sheath 24, which preferably may have a length of approximately an inch or more, encases an equal length of the end 80 of coaxial cable 12.

The next step is to force the conductive sheath 24 into bore 30 of conductive handle 22 from the end of entrance portion 32. This may be effected independent of plug body 26 that would be subsequently screwed to handle 22. However, it is preferable that this step be effected in response to screwing threads 34 of handle 22 to mating threads 64 of plug body 26 to draw the two respective parts together in a manner to be described. More specifically, referring to FIG. 4, sheath 24 is shown partially within bore 30, and the respective threads 34 and 64 of handle 22 and plug body 26 are in a state of initial engagement. In such state, the flared or ear portions 82 of fingers 46 are disposed in the entrance portion 32 of bore 30. Therefore, fingers 46 remain in a flared state. Further, lip 56 of sheath 24 is spaced from wall member 66 of plug body 26, and centrally aligned point end 76 is spaced from center conductor 14 of coaxial cable 12.

Figure 5:
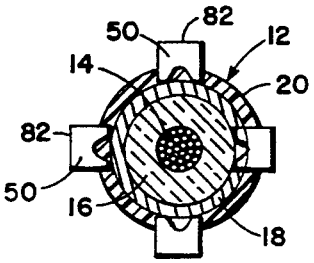
FIG. 5 is a sectioned view of the coaxial cable within the sheath after insertion into the handle.

As threads 34 and 64 are screwed together, plug body 26 and handle 22 are pulled together. During such operation, wall member 66 comes in contact with lip 56 and starts to push sheath 24 on the end of cable 12 further into bore 30. In particular, ear portions 82 of fingers 46 a guided inwardly along ramp portion 36 of bore 30. In such manner, fingers 46 are compressed by sliding engagement wherein, the forks 50 on the free ends of fingers 46 pass inwardly through windows 44 and pierce the outer insulation layer 20 of coaxial cable 12. The dimensions of the respective parts are selected to enable sharp edged forks to contact outer conductor 18 when ears are fully received in internal portion 38 of diameter D2. For example, as shown in FIG. 5, forks 50 straddle a portion of outer conductor 18, and if outer conductor is braided, some of the braids may be clumped into the crotch of forks 50 thereby enhancing the electrical continuity between sheath 24 and outer conductor 18. Outer conductor 18, sheath 24, handle 22 and plug body 26 are all conductive and all are directly or indirectly in contact with each other in the manner heretofore described, so there is electrical continuity between all of these parts. Importantly, there is electrical continuity between the cylinder 58 of plug body 26 and outer conductor 18. Cylinder 58 inserts in and is grounded by a mating jack (not shown), and outer conductor 18 shields inner or center conductor 14 that carries the input signal.

Still referring to FIG. 1 that shows the audio connector plug 10 after plug body 26 and handle 22 are drawn together in fully assembled form, point end 76 is forced into engagement with center conductor 14, so there is electrical continuity between tip end 74 of tip rod 28 and center conductor 14. It should be appreciated that the connection of the outer conductor 18 and center conductor 14 to their respective parts of audio connector plug 10 as described is effected automatically by screwing the handle 22 to the plug body 26.

The piercing of outer insulation layer 20 by the free ends of fingers 46 functions to secure sheath 24 and coaxial cable 12 together, and the sheath 24 is secured within bore 30 by shoulder 86. Further, strain relief for cable 12 is enhanced by causing sheath to crimp down on cable 12. More specifically, crimp portion 40 and rearwardly extending cylinder 62 taper down in opposite directions to compress or crimp the two ends of sheath 24. More specifically, the ends of sheath 24 are driven into regions of diminishing diameter and legs or collets 84 between slits 52 crimp down on cable 12. Further, ribs 54 function to localize the force to deform into outer insulation layer 20 thereby greatly increasing the destructive withdrawal force of cable 12 from audio connector plug 10. The tapering down of rearwardly extending cylinder 62 also serves to hold coaxial cable in secure alignment with point end 76 of tip rod 28 to further ensure electrical continuity between the two. It may also be desirable to cover handle 22 with a conventional boot (not shown) that would further enhance lateral strain relief.

With the arrangement of audio connector plug 10 and the method of assembly as described, plug 10 is attached to the end 80 of a coaxial connector without the use of solder. Further, the assembly is completed without the use of tools, and no cable preparation is required. Thus, assembly is accomplished with minimal labor, and in the field where tools may not be available. Furthermore, the connections of the plug handle 22 to the outer conductor 18, and tip rod 28 to the center conductor 14 are automatically actuated or effected by screwing handle 22 and plug body 26 together. Therefore, highly reliable electrical continuity results.

This concludes the description of the preferred embodiment. However, a reading of it by one of skill in the art will bring to mind many modifications and alterations that do not depart from the spirit and scope of the invention. Therefore, it is intended that the scope of the invention be limited only by the appended claims.

What is claimed is:

1. A method of attaching a connector plug to an end of a coaxial cable having an outer insulation layer surrounding an outer conductor insulated from an inner conductor, comprising the steps of:

inserting the end of the coaxial cable through a central bore of a conductive handle;

inserting the end of the coaxial cable into a conductive sheath having a plurality of circumferentially spaced flexible fingers flared outwardly and pointing in the direction of the end of the cable, each of said fingers having a free end directed inwardly towards said cable;

forcing said conductive sheath into said bore of said handle to cause a surface portion of said bore to contact said conductive sheath to force said finger inwardly wherein said free end pierces said outer insulation layer of said cable and contacts said outer conductor to provide electrical continuity between said outer conductor and said handle through said free end of said, said sheath further comprising a cylinder having a plurality of windows each aligned to pass a respective one of said free ends of said fingers as said fingers are forced inwardly; and connecting a conductive plug body insulatingly encasing a tip rod to said handle, said tip rod having a tip end and a point end, said point end being aligned to electrically contact the center conductor of said coaxial cable to provide electrical continuity between said center conductor and said tip end of said tip rod.

2. The method recited in claim 1 wherein said bore of said handle has an entrance portion having a first diameter, an internal portion having a second diameter less than said first diameter, and a ramp portion of tapered diameter between said entrance portion and said internal portion, and sliding engagement with said ramp portion forces said fingers inwardly to pierce said outer insulation layer.

3. The method recited in claim 1 wherein said connecting step comprises a step of screwing threads on said plug body to mating threads on said handle to draw said plug body and said handle together to form said connector plug, and said step of forcing said conductive sheath into said bore of said handle is responsive to said drawing of said plug body and said handle together.

4. The method recited in claim 1 wherein said free end of said finger comprises a sharp edged fork aligned to contact said outer conductor.

5. The method recited in claim 1 wherein said sheath comprises means responsive to engagement with wall portions of said bore for crimping said sheath to said coaxial cable.

6. The method recited in claim 5 wherein said crimping means comprises collets on said sheath compressed by said wall portions of said bore.

7. A method of attaching a connector plug to an end of a coaxial cable having an outer insulation layer surrounding an outer conductor insulated from an inner conductor, comprising the steps of:

inserting a flush clean cut end of the coaxial cable through a central bore of a conductive handle having threads on a first end towards said flush clean cut cable end after insertion through said bore, said bore at said first end of said conductive handle having an entrance portion having a first diameter tapering down in a ramp portion to an internal portion having a second diameter less than said first diameter;

inserting the flush clean cut end of the coaxial cable into a conductive sheath having a plurality of circumferentially spaced flexible fingers each flared outwardly in the direction of the flush clean cut end of the cable, each of said fingers having a sharp free end directed inwardly towards said cable; and screwing threads of a conductive plug body to said threads of said handle to draw said handle and said plug body together and form said connector plug, said plug body insulatingly surrounding a tip rod having a tip end and a point end, said point end being aligned to be drawn into electrical contact with the center conductor at the flush clean cut end of said coaxial cable to provide electrical continuity between said center conductor and said tip end, said plug body comprising means responsive to said handle and said plug body drawing together to push said sheath into said bore of said handle wherein said fingers are radially compressed by sliding engagement with said ramp portion of said bore to cause said sharp free ends of said fingers to pierce said outer insulation layer of said cable until said sharp free ends contact said outer conductor to provide electrical continuity between said outer conductor and said handle and said plug body through said sharp free ends of said fingers.

8. The method recited in claim 7 wherein said sheath comprises a cylinder having a plurality of windows each aligned to receive a representative one of said free ends of said fingers as said fingers are forced inwardly.

9. The method recited in claim 7 wherein said free end of said finger comprises a pair of points aligned to contact said outer conductor.

10. The method recited in claim 7 wherein said sheath comprises means responsive to engagement with wall portions of said bore for crimping said sheath to said coaxial cable.

11. The method recited in claim 10 wherein said crimping means comprises collets on said sheath compressed by said wall portions of said bore.

12. A connector plug adapted for solderless connection to an end of a coaxial cable having an outer insulation layer surrounding an outer conductor insulated from an inner conductor, said plug comprising:

a conductive handle having a central bore adapted for passage of said end of said coaxial cable, said handle having threads at one end;

a conductive sheath adapted for insertion of said end of said coaxial cable, said sheath comprising a cylinder having a plurality of fingers circumferentially spaced around said sheath and flared outwardly and pointing in the direction of the end of said coaxial cable, said cylinder of said sheath having a plurality of windows each aligned to pass a respective one of said fingers as said fingers are forced inwardly;

a conductive plug body having threads mateable with said threads of said conductive handle to draw said handle and said plug body together to form said connector plug, said plug body comprising means for pushing said sheath into said bore in response to said plug body and said handle drawing together, said bore comprising means responsive to movement of said sheath into said bore for forcing said finger inwardly to pierce said outer insulation layer and make contact with said outer conductor to provide electrical continuity between said outer conductor and said handle and plug body through said finger, said plug body insulatingly surrounding a tip rod having a tip end and a point end, said point end being centrally aligned within said plug body to electrically contact said center conductor of said coaxial cable to provide electrical continuity between said center conductor and said tip end.

13. The plug connector recited in claim 12 wherein said bore has as entrance portion having a first diameter tapering down in a ramp portion to an internal portion having a second diameter less than said first diameter, said finger being forced inwardly in response to sliding engagement along said ramp portion.

14. The connector plug recited in claim 12 wherein said free end of said finger comprises a sharp edged fork aligned to contact said outer conductor.

15. The connector plug recited in claim 12 wherein said sheath further comprises means responsive to being inserted in said bore for crimping said coaxial cable.

16. The connector plug recited in claim 15 wherein said crimping means comprises collet means compressed by wall portions of said bore during insertion of said sheath into said bore.

17. A method of attaching a connector plug to an end of a coaxial cable having an outer insulation layer surrounding an outer conductor insulated from an inner conductor, comprising the steps of:

inserting the end of the coaxial cable through a central bore of a conductive handle having threads on the end towards said cable end after insertion through said bore, said bore having an entrance portion having a first diameter tapering down in a ramp portion to an internal portion having a second diameter less than said first diameter;

inserting the end of the coaxial cable into a conductive sheath having a plurality of circumferentially spaced flexible fingers each flared outwardly in the direction of the end of the cable, each of said fingers having a sharp free end directed inwardly towards said cable; and screwing threads of a conductive plug body to said threads of said handle to draw said handle and said plug body together to form said connector plug, said bore of said handle and a bore of said plug body having regions of reduced crosssection to crimp both ends of said sheath around said coaxial cable to secure said sheath to said coaxial cable, said plug body insulatingly surrounding a tip rod having a tip end and a point end, said point end being aligned to be drawn into electrical contact with the center conductor of said coaxial cable as said handle and plug body are screwed together to provide electrical continuity between said center conductor and said tip end, said plug body comprising means responsive to said handle and said plug body drawing together to push said sheath into said bore of said handle wherein said fingers are radially compressed by sliding engagement with said ramp portion of said bore and said sharp free ends of said fingers pierce said outer insulation layer of said cable to provide electrical continuity between said outer conductor and said handle and said plug body.

18. The method as recited in claim 17 wherein said sheath comprises a cylinder having a plurality of windows each aligned to receive a respective one of said free ends of said fingers as said fingers are forced inwardly.

* * * * *